US007650915B2

(12) United States Patent
Hsu

(10) Patent No.: US 7,650,915 B2
(45) Date of Patent: Jan. 26, 2010

(54) METHOD FOR REMOVING VAPOR WITHIN HEAT PIPE

(76) Inventor: Hul-Chun Hsu, 6F, No. 422, Sec. 2, Li-Ming Road, Taichung (TW)

( * ) Notice: Subject to any disclaimer, the term of this patent is extended or adjusted under 35 U.S.C. 154(b) by 486 days.

(21) Appl. No.: 11/467,154

(22) Filed: Aug. 24, 2006

(65) Prior Publication Data

US 2006/0283578 A1 Dec. 21, 2006

Related U.S. Application Data

(63) Continuation-in-part of application No. 10/843,624, filed on May 12, 2004, now abandoned.

(51) Int. Cl.
*B65B 31/02* (2006.01)

(52) U.S. Cl. ..... 141/8; 141/59; 29/890.032

(58) Field of Classification Search ..... 165/104.27; 29/890.032; 141/3

See application file for complete search history.

(56) References Cited

U.S. PATENT DOCUMENTS

| | | | | |
|---|---|---|---|---|
| 4,341,000 | A * | 7/1982 | Stockman | 29/890.032 |
| 5,743,014 | A * | 4/1998 | Giammaruti et al. | 29/890.032 |
| 5,895,868 | A * | 4/1999 | Giammaruti et al. | 73/863.81 |
| 6,698,469 | B2 * | 3/2004 | Sakamoto et al. | 141/91 |
| 2003/0141667 | A1 * | 7/2003 | Emoto et al. | 277/410 |

FOREIGN PATENT DOCUMENTS

| | | | |
|---|---|---|---|
| JP | 54053345 | A * | 4/1979 |
| JP | 55068585 | A * | 5/1980 |
| JP | 55068586 | A * | 5/1980 |
| JP | 57179589 | A * | 11/1982 |
| JP | 58088594 | A * | 5/1983 |
| JP | 04015490 | A * | 1/1992 |
| JP | 04015491 | A * | 1/1992 |
| SU | 506738 | * | 5/1976 |
| SU | 1455212 | * | 1/1989 |

* cited by examiner

*Primary Examiner*—Allen J Flanigan
(74) *Attorney, Agent, or Firm*—Chun-Ming Shih

(57) ABSTRACT

A method for removing vapor within a heat pipe includes providing a predetermined amount of working fluid injected into the heat pipe. An opening is reserved at one end of the heat pipe. The opening is communicated with a vacuum environment. The communication between the opening and the vacuum environment is normally disconnected, such that at the instant the communication is connected ,the vacuum level of the vacuum environment is maintained at a certain range. The communication between the opening of the heat pipe and the vacuum environment is intermittently connected for several times. Within the duration while the communication between the opening and the vacuum environment is connected, the working fluid is evaporated without being boiled and vapor is exhausted from the opening.

7 Claims, 5 Drawing Sheets

METHOD FOR REMOVING VAPOR WITHIN HEAT PIPE

RELATED APPLICATIONS

This application is a continuation-in-part of U.S. patent application Ser. No. 10/843,624, filed on May 12, 2004 now abandoned.

BACKGROUND OF THE INVENTION

The present invention relates generally to a method for removing vapor within a heat pipe and, more particularly, to a method for removing vapor within a thermal tube while precisely controlling the amount of the working fluid to be sealed in the heat pipe.

Heat pipes, by having the features of quick thermal response, high thermal conductivity, no moving parts, simple structure and multi-functions, can transfer huge amount of heat without consuming significant amount of electricity. Therefore, heat pipes are suitable for heat dissipation of electronic products. In addition, the interior wall of the conventional heat pipe includes wick structure. The wick structure includes web for capillary effect, which is advantageous for transmission of working fluid in the heat pipe.

However, while fabricating the heat pipes, the vapor within the heat pipe is typically exhausted together with the liquid working fluid, such that the remaining amount of the working fluid within the heat pipe cannot be precisely controlled. The control quality of the heat pipes is thus very poor. Further, the incompleteness of vapor within the heat pipes results in poor heat flow effect.

Therefore, there exist inconvenience and drawbacks for practically application of the above conventional heat pipes. There is thus a substantial need to provide a method and an apparatus for removing vapor within a heat pipe that resolves the above drawbacks and can be used more conveniently and practically.

BRIEF SUMMARY OF THE INVENTION

The present invention provides a method for removing vapor within a heat pipe. During the process of exhausting vapor within the heat pipe, the amount of working fluid within the heat pipe is precisely controlled, and the vapor is more thoroughly removed. Therefore, a stable amount of the working fluid is maintained, heat pipes with improved quality are fabricated, and a better heat flow is obtained.

The present invention provides a method to remove vapor within a heat pipe. The method comprises the following steps. A predetermined amount of working fluid is injected into a heat pipe. An opening is reserved at one end of the heat pipe. The opening is communicated with a vacuum environment. The communication between the opening and the vacuum environment is normally disconnected, such that at the instant the communication is connected, the vacuum level of the vacuum environment is maintained at a certain range. The communication between the opening of the heat pipe and the vacuum environment is intermittently connected for several times. Within the duration while the communication between the opening and the vacuum environment is connected, the working fluid is evaporated without being boiled and vapor is exhausted from the opening.

BRIEF DESCRIPTION OF THE DRAWINGS

These, as well as other features of the present invention, will become more apparent upon reference to the drawings wherein.

DETAILED DESCRIPTION OF THE INVENTION

Figure 1:
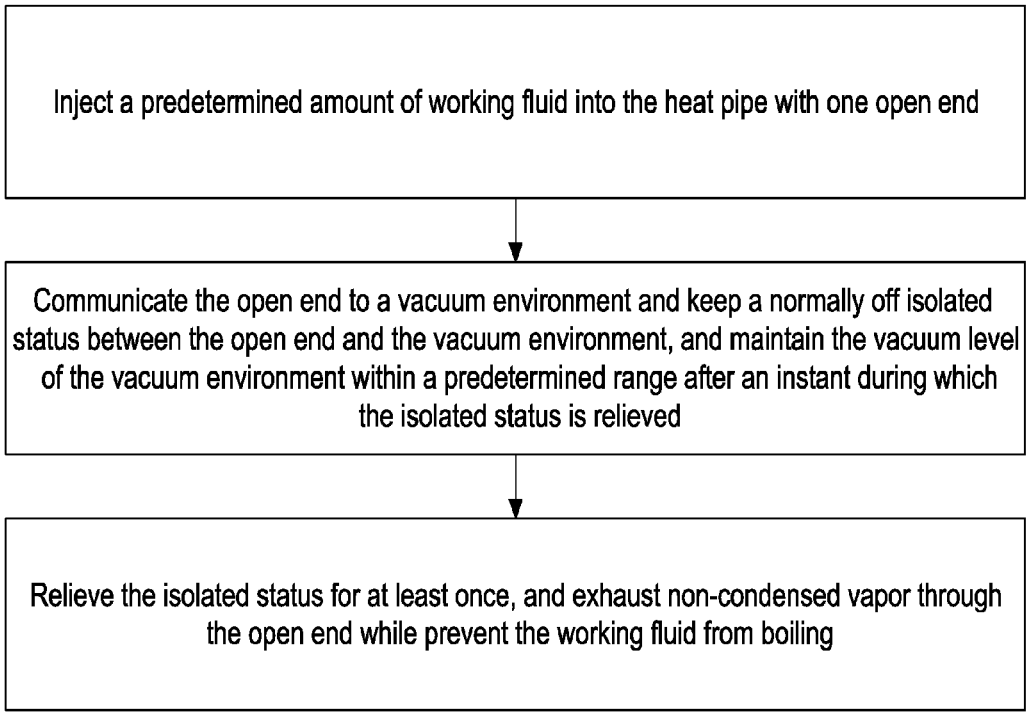
FIG. 1 shows a process of the method for removing vapor within a heat pipe according to the present invention.
Figure 2:
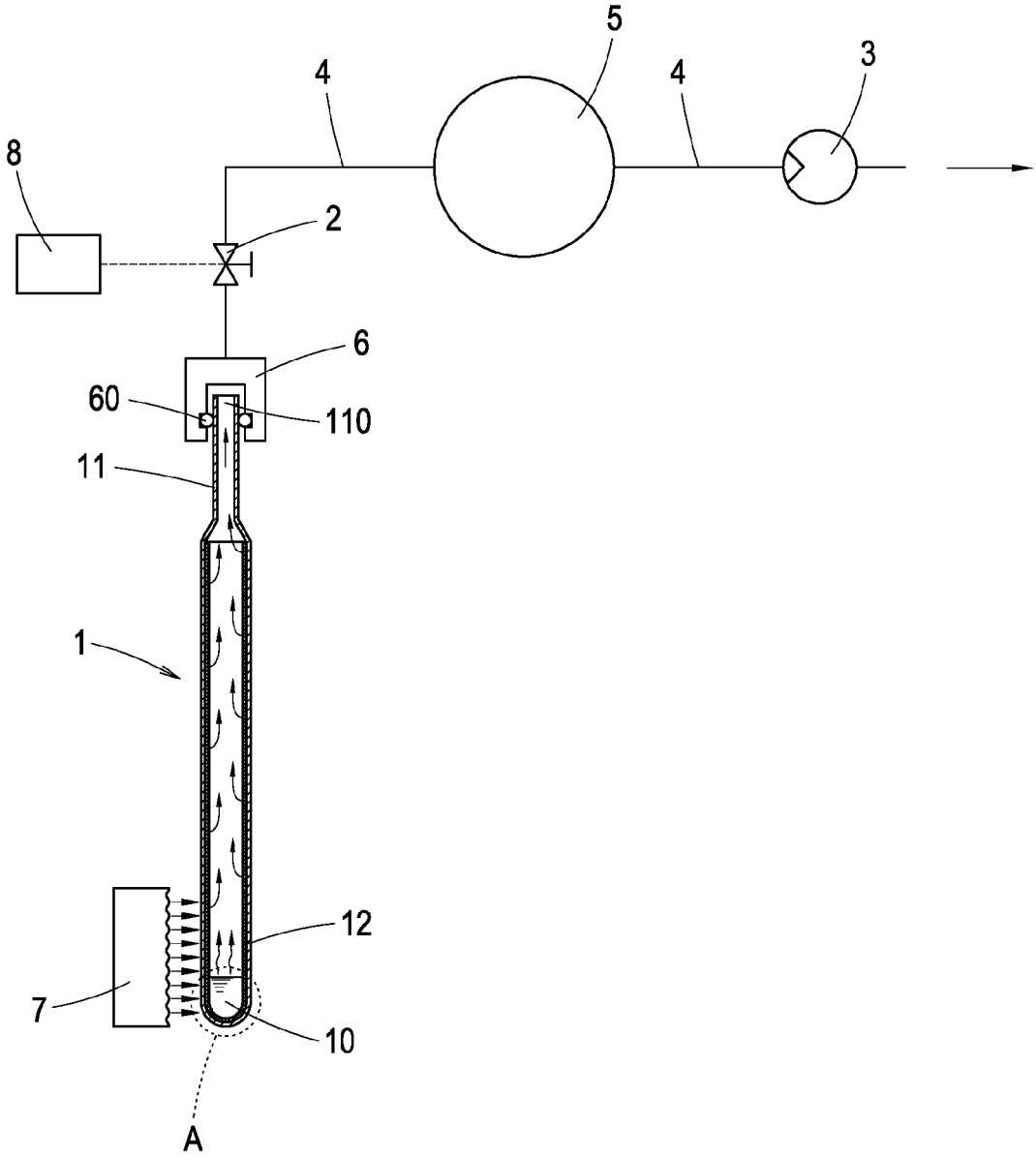
FIG. 2 shows the operation of the apparatus provided by the present invention.
Figure 3:
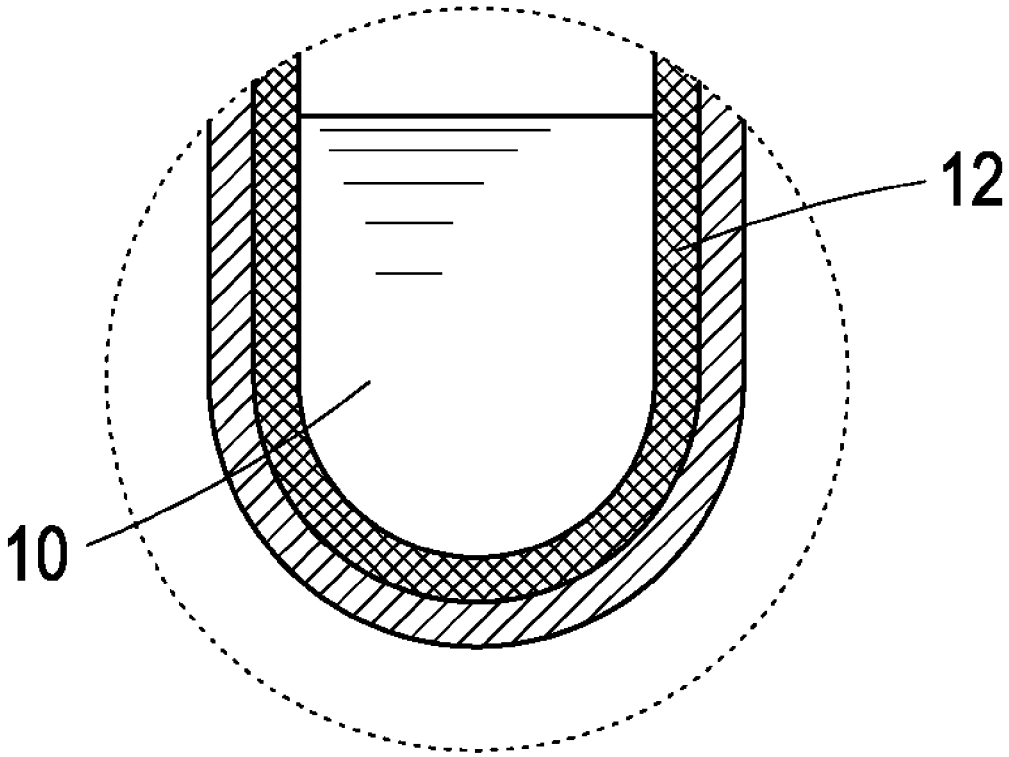
FIG. 3 shows a local enlarged view of FIG. 2.

Referring to FIGS. 1 and 2, the process flow of the method and operation of the apparatus for removing vapor within a heat pipe provided by the present invention are illustrated. The method includes injecting a predetermined amount of working fluid 10 into a heat pipe 1 (as shown in FIG. 3). An opening 110 is reserved at one end of the heat pipe 1. Preferably, the predetermined amount is slightly more than the amount of working fluid to be sealed in the heat pipe 1. The interior wall of the heat pipe 1 includes wick structure 12, while the opening is formed at the sealing end 11 of the heat pipe.

The opening 110 is communicated to a vacuum environment. The communication between the opening 110 and the vacuum environment is normally disconnected. At the communication between the opening 110 and the vacuum environment is connected, the vacuum level of the vacuum environment is maintained within a certain range. This is achieved by continuously pumping the vacuum environment. The interior capacity of the vacuum environment is preferably far larger than that of the heat pipe. In this embodiment, the vacuum environment includes a pressure buffer 5 and a vacuum circuit 4 as shown in FIG. 2. A valve 2 controls the communication between the opening 110 of the heat pipe 1 and the vacuum environment.

The communication between the opening 110 of the heat pipe 1 and the environment is intermittently connected for several times, and the working fluid within the heat pipe 1 is evaporating and prevented from being boiling while vapor is exhausted. In this step, the working fluid within the heat pipe 1 is prevented from being boiling to spray out of the thermal tube 1 that may lose control of the remaining amount of the working fluid within the heat pipe 1. Therefore, the communication is connected under the circumstance that the working fluid 10 is evaporating, but is not boiling. Once the communication is connected, a negative pressure is formed near the opening 110 of the heat pipe 1 to instantly vaporize the working fluid 10. Therefore, the communication has to be disconnected immediately to avoid the working fluid 10 spraying out due to boiling. That is, a small amount of the exhausted vapor is maintained, and the remaining amount of the working fluid 10 within the heat pipe 1 is precisely controlled. The duration for connecting the communication depends on the required amount the working fluid to be sealed in the heat pipe 1, the dimension of the heat pipe 1, and the gauge of the opening 110.

If the residual vapor in the heat pipe 1 after one exhaust exceeds a tolerable range, the step of connecting the communication between the opening 110 and the vacuum environment is repeated until the amount of the residual vapor falls within the tolerable range.

In addition, to accelerate the exhaust of the vapor accumulated near the opening 110 of the heat pipe 1, the bottom end of the heat pipe 1 is heated to cause a temperature gradient from the bottom to the top end (sealing end) of the heat pipe 1. Thereby, the gas and liquid within the heat pipe 1 are circulated, allowing vapor accumulated near the top end of the heat pipe 1. When the opening 110 is conducted with the vacuum environment, the vapor near the opening 110 is first exhausted. Therefore, the remaining amount of the working fluid 10 within the heat pipe 10 can be precisely controlled to enhance the exhaust efficiency.

When the amount of the vapor within the heat pipe 1 is within the tolerable range, the sealing end 11 of the heat pipe 1 is sealed.

By the above processes, a heat pipe 1 within which vapor has been exhausted is obtained.

Referring to FIG. 2, an apparatus for removing vapor within a heat pipe according to the method of the present invention comprises a valve 2, a vacuum apparatus 3 and a vacuum conduit 4 serially connected between the valve 2 and the vacuum apparatus 3.

The valve 2 includes a solenoid valve or a pneumatic valve, and the vacuum apparatus 3 includes a vacuum pump, for example. When the vacuum conduit 4 is serially connected to the valve 2 and the vacuum apparatus 3, the valve 2 is conducted with the vacuum apparatus 3. Thereby, a vacuum condition is maintained by continuous operation of the vacuum apparatus 3. A pressure buffer 5 may further be installed on the vacuum conduit 4 between the valve 2 and the vacuum apparatus 3. The pressure buffer 5 includes an accumulator, for example, to temporarily store the exceeding pressure within the heat pipe 1, so as to stabilize the vacuum level within the vacuum pipe 4. In the above mentioned method, the vacuum environment includes the vacuum conduit 4, or the assembly of the vacuum conduit 4 and the pressure buffer 5. The vacuum level within the vacuum conduit 4 and the pressure buffer 5 is maintained by continuously operation of the vacuum apparatus 3.

A pipe connector 6 is further installed at one end of the valve 2 distal to the vacuum apparatus 3. The pipe connector 6 is used to connect the opening 110 of the heat pipe. A gas sealing ring 60 is included between the pipe connector 6 and the opening 110 to ensuring a proper sealing effect at the joint of the pipe connector 60 and the heat pipe 1. In addition, to accelerate exhaust of the vapor, a heating apparatus 7 is provided at the bottom end of the heat pipe 1.

The valve 2 is normally off and intermittently switched on and off. A controller 8 is used to control the number of switch operation, the duration for each switch operation, and the time interval between the switch operations. The controller 8 comprises a programmable logic controller (PLC), by which a small amount of vapor is exhausted each time, while the amount of the working fluid 10 within the heat pipe is precisely controlled.

Figure 4:
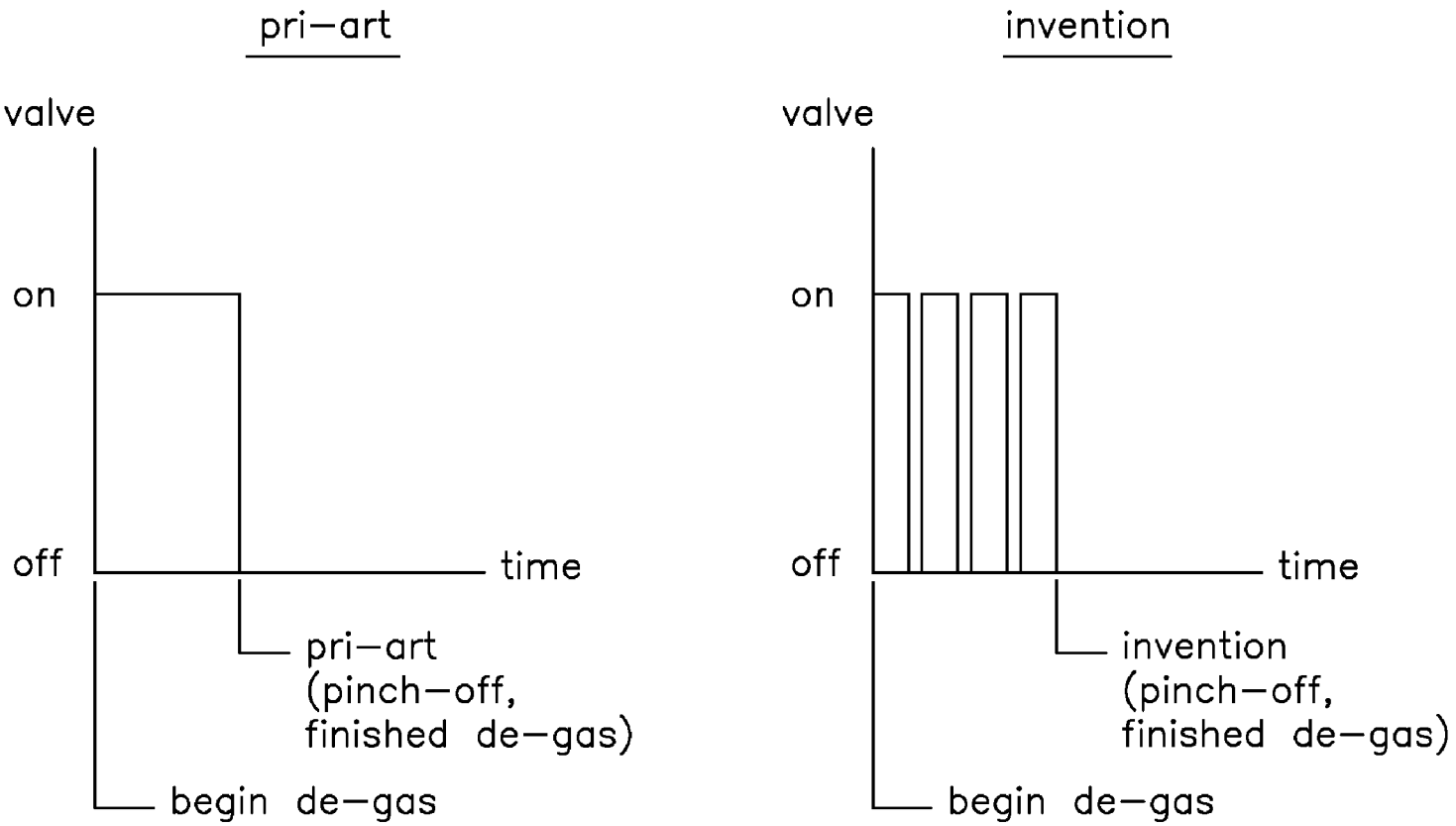
FIG. 4 shows the method of the present invention comparing with the conventional method for the operation of controlling the valve.
Figure 5:
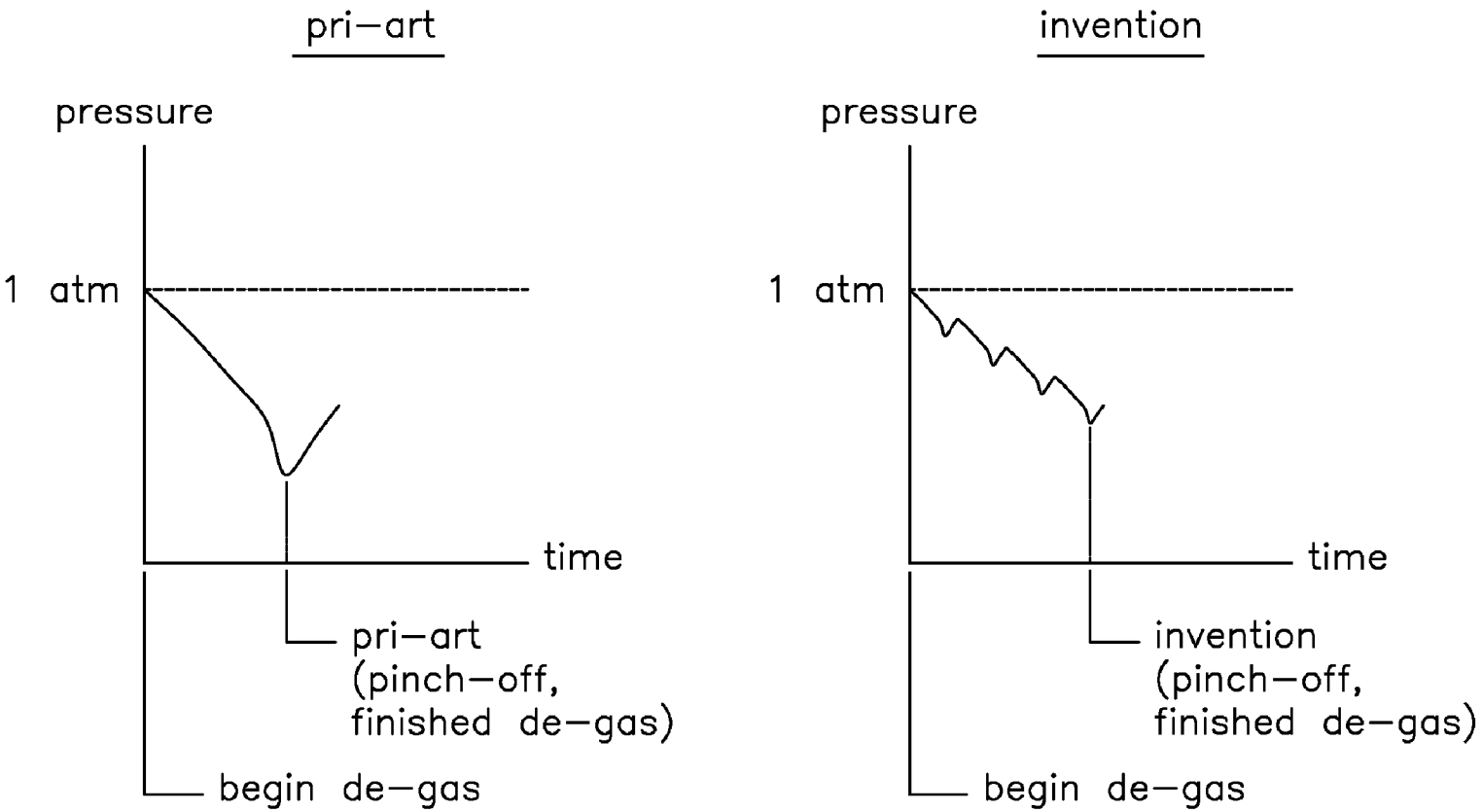
FIG. 5 shows the method of the present invention comparing with the conventional method for the pressure variations within the heat pipe.

Referring to FIG. 4, in comparison with the conventional process at operation of controlling the valve, the method for removing the vapor within the heat pipe of the present intermittently relieves the valve 2 for several times; however, there is only once for conventional method. Furthermore, please refer to FIG. 5 of comparing the pressure variations within the heat pipe between the method of the present invention and the conventional method when the vapor within the heat pipe is removed. In conventional method, the pressure variations are violent so that the pressure difference is huge and the pressure field is unsteady. Moreover, since degassing has to be completed at one time, the vapor is severely exhausted and the degassing amount of the vapor cannot be precisely controlled. However, in the present invention, since the degassing process is intermittently performed for several times, the pressure variations in the heat pipe are smooth and low. Therefore, the pressure difference in each degassing is small and the pressure field is stable. Meanwhile, each degassing amount of vapor needs not to be too much but adequate to have all of the vapor to be exhausted as possible after several times. As such, the operation and the amount of removing the vapor within the heat pipe can be precisely controlled.

By the method provided according to the present invention, the amount of the working fluid to be sealed within the heat pipe can be precisely controlled during the exhaust process of the vapor within the heat pipe. The quality of the heat pipe is thus enhanced, and a better thermal flow can be obtained.

Other embodiments of the invention will appear to those skilled in the art from consideration of the specification and practice of the invention disclosed herein. It is intended that the specification and examples to be considered as exemplary only, with a true scope and spirit of the invention being indicated by the following claims.

What is claimed is:

1. A method of removing vapor within a heat pipe, comprising:

a) injecting a predetermined amount of working fluid into the heat pipe, and forming an opening on a top end of the heat pipe;

b) communicating the opening with a vacuum environment and keeping communication between the opening and the vacuum environment normally disconnected, such that vacuum level of the vacuum environment is maintained within a predetermined range after the communication is intermittently connected; and c) intermittently connecting the communication status between the opening and the vacuum environment when the working fluid within the heat pipe is evaporating without being boiling.

2. The method of claim 1, wherein step (b) further comprises continuously vacuuming the vacuum environment to maintain the vacuum level thereof.

3. The method of claim 1, wherein step (b) further comprises communicating the opening with the vacuum environment with an interior capacity larger than that of the heat pipe.

4. The method of claim 1, wherein step (c) further comprises a step of heating a bottom end of the heat pipe to generate a temperature gradient.

5. The method of claim 1, wherein step (c) further comprises disconnecting the communication between the opening and the vacuum environment before the working fluid within the heat pipe is boiling.

6. The method of claim 5, further comprising repeating step (c) until amount of residual vapor within the heat pipe is within than a tolerable range.

7. The method of claim 1, further comprising a step of sealing the opening when the amount of vapor within the heat pipe is within a tolerable range.

* * * * *